United States Patent [19]

Zwiener et al.

[11] 4,381,802

[45] May 3, 1983

[54] CLOTH TEMPLING DEVICE FOR LOOMS

[75] Inventors: Rudolf Zwiener; Werner Beer, both of Arbon; Giuseppe D. Santo, Gallen, all of Switzerland

[73] Assignee: Aktiengesellschaft Adolph Saurer, Arbon, Switzerland

[21] Appl. No.: 262,681

[22] Filed: May 11, 1981

[30] Foreign Application Priority Data

May 23, 1980 [CH] Switzerland ..... 4049/80

[51] Int. Cl.[3] ..... D03J 1/22

[52] U.S. Cl. ..... 139/294

[58] Field of Search ..... 139/292, 293, 294, 295, 139/298; 26/87, 88, 89

[56] References Cited

U.S. PATENT DOCUMENTS

| | | | |
|---|---|---|---|
| 2,603,245 | 7/1952 | Hoffman | 139/295 |
| 3,254,679 | 6/1966 | Goldschmid | 139/294 |
| 3,800,835 | 4/1974 | Riha et al. | 139/294 |
| 3,807,004 | 4/1974 | Anderson | 26/88 |
| 3,901,290 | 8/1975 | Jindra | 139/294 |

FOREIGN PATENT DOCUMENTS

| | | | |
|---|---|---|---|
| 1079284 | 5/1954 | France | 139/294 |
| 642785 | 9/1950 | United Kingdom | 139/294 |

*Primary Examiner*—Henry Jaudon

*Attorney, Agent, or Firm*—Werner W. Kleeman

[57] ABSTRACT

A fabric or cloth templing device for a loom comprises a part provided with a temple containing a porcupine or needle roller or ring. Over the temple there extends a domed cover member in order to place the selvedge or marginal region of a cloth or fabric web into contact with the needled jacket surface or shell of the porcupine roller or ring. Arranged after the temple is a contact roll which coacts with a countersurface, in order to subsequently fixedly retain the fabric which has been spread by the porcupine rollers. By virtue of these measures it is possible to ensure in a most simple manner an effective traction relief with increasing fabric tension.

13 Claims, 2 Drawing Figures

CLOTH TEMPLING DEVICE FOR LOOMS

BACKGROUND OF THE INVENTION

The present invention relates to a new and improved construction of a cloth or fabric templing device for use with a loom.

Generally speaking, the fabric templing device of the present development is of the type wherein the temples each contain a porcupine or needle roller for each selvedge of the woven fabric or cloth. A domed cover member extends over each temple in order to place the related selvedge of the fabric web against the jacket surface or shell of the associated temple.

Apart from clamping jaw-templing devices, for instance of the type disclosed in Swiss Pat. No. 461,403, there are increasingly used at looms roll-templing devices of the aforementioned type. With such templing devices the selvedges as well as a narrow marginal region of the fabric travels over the porcupine rollers arranged to both sides of the woven fabric web immediately after the insertion of the weft thread, in order to counteract contraction of the fabric web following the momentary insertion of the weft thread. Such type of cloth templing device has been disclosed for instance in German Pat. No. 1,134,939. Here, it is intended that the arrangement of the needles is located only to such extent upon the porcupine rollers that only the fabric marginal zones, not however the body of the cloth or fabric, meaning the portion of the fabric inwardly of the marginal zones, is subjected to the action of the needles of the porcupine rollers.

In the case of fabric webs containing an extremely high cloth density and a correspondingly high cloth or fabric tension, which is discernible in the form of a pronounced fabric traction in the weft insertion direction, a drawback of the fabric or cloth templing devices of the aforementioned type resides in the fact that they are no longer capable of sufficiently retaining the cloth or fabric in that such tends to tear immediately adjacent the needle arrangement.

According to French Pat. No. 1,037,803 attempts have been made to avoid such shortcomings in that at least two of the prior art cloth templing devices are arranged behind one another. Other known proposals contemplate using alone or in addition clamping jaw-templing devices. Of course, these solutions are extremely complicated and, as a general rule, uneconomical because of their increased cost.

SUMMARY OF THE INVENTION

Therefore, with the foregoing in mind it is a primary object of the present invention to provide an improved construction of cloth or fabric templing device which is not associated with the aforementioned drawbacks and limitations of the prior art constructions heretofore discussed.

Another and more specific object of the present invention aims at rendering possible traction relief of the woven fabric with the aid of simple means, without relinquishing the use of the well proven fabric templing devices utilising porcupine or needle rollers and enabling a faultless spreading of the fabric while rendering impossible undesired stretching or tearing-out of the fabric web at the marginal regions thereof.

Another more specific object of the present invention aims at providing a new and improved construction of fabric templing device which is relatively simple in design, economical to manufacture, extremely reliable in operation, not readily subject to breakdown or malfunction, and requires a minumum of maintenance and servicing.

Now in order to implement these and still further objects of the invention, which will become more readily apparent as the description proceeds, the fabric templing device of the present development is manifested by the features that a contact roll is arranged following the porcupine or needle roller. This contact roll coacts with a countersurface, in order to subsequently fixedly retain the fabric which has been spread by the action of the needle rollers located at the selvedge regions of the woven fabric.

The countersurface provided for the contact roll can be constituted by a support plate or a counter roll or roller. In each case and through the provision of the most simple constructional means there is obtained a sufficient traction relief such that the fabric can be held spread apart without danger of tearing by the porcupine rollers.

The simple concept of a fabric templing device which is realised through the use of the inventive measures enables easy retrofitting of already existing weaving machines or looms.

Depending upon the field of application it can be advantageous in order to obtain a sufficient traction relief to orient the contact roll such that it extends essentially parallel or at an inclination to the cloth or fabric fell. The contact roll can possess a substantially cyclindrical or conical configuration and be provided with a special covering.

It is furthermore advantageous if the contact roll is subjected to the action of contact or pressing elements and if the effective contact surface of the contact roll is arranged offset towards the center of the fabric with respect to the jacket surface or shell of the temple.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
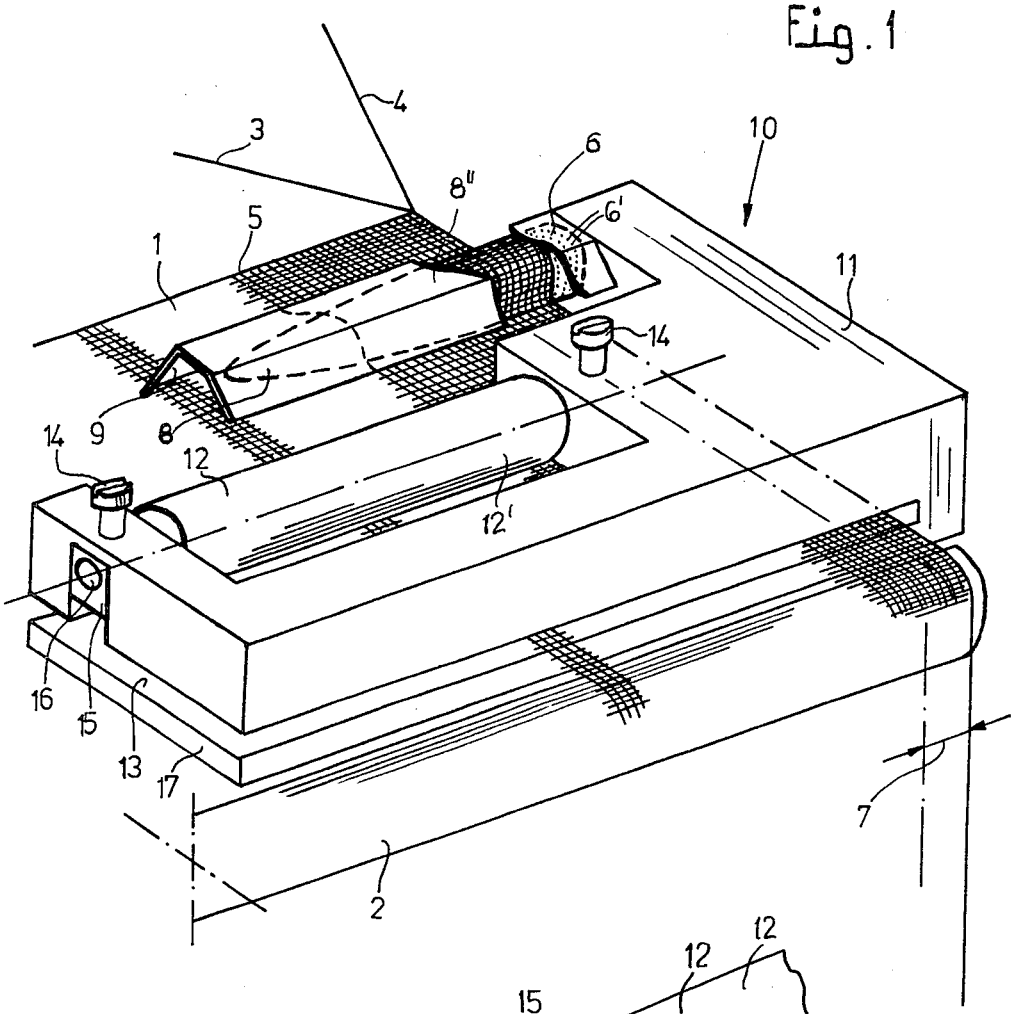
FIG. 1 illustrates in perspective and schematic view a portion of a fabric templing device arranged at a loom and constructed according to the invention.

Describing now the drawings, it is to be understood that only enough of the construction of the loom has been shown to enable those skilled in the art to readily understand the underlying principles and concepts of the present development. Turning attention now specifically to FIG. 1, there has been illustrated therein a loom which only has been represented by the marginal portion at one side of a cloth or fabric web 1 and a breast beam 2. Consequently, there also has been only illustrated the inventive fabric templing device 10 located at the depicted side of the cloth or fabric. In particular, it will be readily evident and understood that a second similarly constructed fabric templing device is located at the other, not particularly illustrated marginal region or selvedge of the fabric web 1, i.e. at the opposite side of the loom.

The fabric or cloth web 1 is formed by the momentary insertion of a here not further shown weft thread into the shed formed by the lowered warp threads 3 and the raised warp threads 4 and the subsequent beating of a weft thread against the fabric fell 5.

As has been previously described, the woven fabric web 1 strives, under the action of the fabric tension, to contract. This undesirable fabric or cloth contraction is prevented by the arrangement of the porcupine or needle rollers 6 of the temple 6, 8 of the fabric templing device 10. The needle rollers 6 engage near to the selvedge or marginal edge of the fabric and may be rotatably supported by temple part 8 which can be configured as a wedge-shaped cloth support portion or also may be constituted as a needle roller supporting axle fixed at the frame part 11.

The cloth supporting portion or part 8 extends freely, i.e. in a cantilever fashion, and with its lengthwise axis dispositioned essentially parallel to the fabric or cloth fell 5. At the selvedge and reinforced marginal region 7 of the fabric web 1 the porcupine or needle roller 6 possesses a roller or roll region provided with needles 6' or equivalent structure. Extending over the depicted temple 6, 8 is a domed or arched cover member 9 in a manner such that the selvedge or marginal region 7 of the fabric web 1 comes into contact with the needled region of the porcupine roller 6 of the related temple 6, 8 as such as has been clearly illustrated in FIG. 1 and as is well known in this technology.

Now in order to counteract an effective tension or tractive force at the selvedge or marginal region which is exerted in the direction of the center of the woven fabric or cloth web 1, there is provided, according to the invention, a contact or press roll 12. This contact or press roll 12 cooperates with a countersurface 13, in order to fixedly retain the fabric 1 which has been spread apart by the action of the porcupine or needle rollers 6 after it has departed from the operative region of such porcupine rollers 6. To this end, the depicted contact roll 12 is rotatably mounted in the frame 11 and is subjected to the action of adjustable contact elements 14, for instance here constituted by adjustment screws arranged at each of the fabric templing devices 10. These contact elements 14 act upon a bearing carriage or slide 15 which supports the journals 16 of the related contact roll 12. The journals 16 of each contact roll 12 are supported at their ends by a suitable support element, here shown in FIG. 2 as constituted by a ball or spherical element 19 which takes-up axial thrust forces exerted by the contact roll 12.

In the exemplary embodiment of FIG. 1 the countersurface 13 is constituted by a support plate 17 which forms part of the frame 11 or equivalent structure.

The frame 11 of the fabric templing device 10 is fixedly attached in any suitable fashion at the related side of the loom.

Furthermore, the arrangement is perfected such that the effective contact or pressing surface 12' of the contact roll 12 is dispositioned in offset relation towards the center of the fabric 1 with respect to the effective outer surface or shell 8'' of the temple 6, 8.

Figure 2:
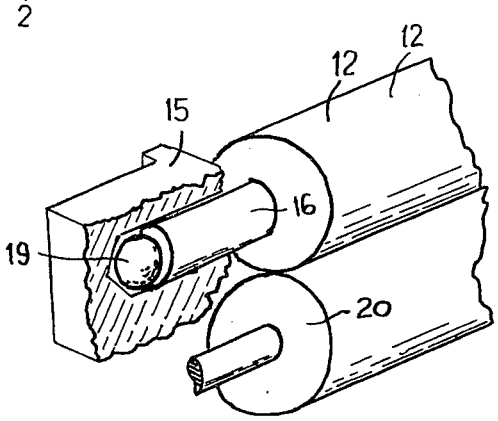
FIG. 2 likewise shows in schematic perspective view, partially in section, a variant embodiment and a detail of the contact roll arrangement.

Alternatively, with the inventive fabric templing device it is possible to utilise for the countersurface of the contact roll 12, instead of the aforementioned support plate 17, a counter roll or roller 20, as this has been shown in the modified arrangement of FIG. 2.

Additionally, it can be advantageous if at least the contact roll 12 is provided with a suitable covering, as generally indicated for instance in FIG. 2 by reference character 12'', in order to afford a protective application of pressure at the woven fabric 1. Obviously, the contact roll 12 of the arrangement of FIG. 1 likewise can be provided with such covering 12'' or equivalent structure.

Different retention actions can be exerted at or upon the fabric 1 in that the contact roll 12 can be arranged such that its lengthwise axis extends essentially parallel to or at an inclination to the fabric fell 5, or the contact roll 12 can be designed to possess a substantially conical or cylindrical configuration.

By virtue of the described measures contemplated by the invention there are realised different constructions of fabric templing devices which completely fulfill all of the heretofore discussed requirements.

While there are shown and described present preferred embodiments of the invention, it is to be distinctly understood that the invention is not limited thereto, but may be otherwise variously embodied and practiced within the scope of the following claims. Accordingly,

What we claim is:

1. In a fabric templing device for looms which contains a respective temple containing a porcupine roller for each fabric selvedge, with a domed cover member extending over each temple in order to place the marginal region of a woven fabric web against an outer surface of the related porcupine roller, the improvement which comprises:

a contact roll operatively associated with a related one of the porcupine rollers;

said contact roll being arranged after the related porcupine roller; and means defining a countersurface with which coacts said contact roll, in order to subsequently fixedly retain the woven fabric which has been spread apart by the porcupine rollers.

2. The improvement as defined in claim 1, wherein:

said means defining said countersurface comprises a support plate.

3. The improvement as defined in claim 1, wherein:

said means defining said countersurface comprises a counter roll.

4. The improvement as defined in claim 1, further including:

means for laterally supporting the contact roll.

5. The improvement as defined in claim 4, wherein:

said laterally supporting means comprise at least one substantially ball-shaped body member.

6. The improvement as defined in claim 1, further including:

adjustable contact means acting upon the contact roll.

7. The improvement as defined in claim 6 wherein:

said adjustable contact means comprises at least one contact element for pressing the contact roll in the direction of said countersurface.

8. The improvement as defined in claim 1, wherein:

said contact roll has a lengthwise axis extending essentially parallel to the fabric fell.

9. The improvement as defined in claim 1, wherein:

said contact roll has a lengthwise axis extending at an inclination with respect to the fabric fell.

10. The improvement as defined in claim 1, wherein:

said contact roll possesses a substantially cyclindrical configuration.

11. The improvement as defined in claim 1, wherein: said contact roll possesses a substantially conical configuration.

12. The improvement as defined in claim 1, wherein: at least said contact roll is provided with a covering.

13. The improvement as defined in claim 1, wherein: said contact roll has an effective contact surface;

said porcupine roller having an effective jacket surface; and the effective contact surface of said contact roll being offset towards the center of the fabric with respect to said effective jacket surface of the porcupine roller.

* * * * *